United States Patent [19]

Roller

[11] Patent Number: 4,722,487

[45] Date of Patent: Feb. 2, 1988

[54] DEVICE FOR TRANSFERRING THE END OF THE THREAD OF A BOBBIN OR COP FROM THE BOBBIN CORE TO A SPOOLING FRAME

[75] Inventor: Siegfried Roller, Fellbach, Fed. Rep. of Germany

[73] Assignee: C. Eugen Maier Metallverarbeitung GmbH, Fed. Rep. of Germany

[21] Appl. No.: 900,367

[22] Filed: Aug. 26, 1986

[30] Foreign Application Priority Data

Aug. 31, 1985 [DE] Fed. Rep. of Germany ..... 3531263

[51] Int. Cl.[4] ..... B65H 54/26

[52] U.S. Cl. ..... 242/35.5 R; 242/35.5 A; 242/35.6 E

[58] Field of Search ..... 242/35.5 R, 35.5 A, 242/35.6 R, 35.6 E, 18 R

[56] References Cited

U.S. PATENT DOCUMENTS

| | | | |
|---|---|---|---|
| 3,261,562 | 7/1966 | Kupper | 242/35.6 R |
| 3,471,101 | 10/1969 | Moyer et al. | 242/35.6 R |
| 3,480,216 | 11/1969 | Iannucci et al. | 242/35.6 R |
| 3,850,377 | 11/1974 | Pitts | 242/35.6 R X |
| 3,850,378 | 11/1974 | Savio | 242/35.5 R |
| 3,966,141 | 6/1976 | Nishiyama et al. | 242/35.6 E X |
| 4,010,907 | 3/1977 | Nishiyama et al. | 242/35.6 E X |
| 4,171,105 | 10/1979 | D'Agnolo et al. | 242/35.6 E X |
| 4,212,433 | 7/1980 | Matsui et al. | 242/35.5 A |
| 4,558,829 | 12/1985 | Aretz et al. | 242/35.5 A |
| 4,589,602 | 5/1986 | Reiners et al. | 242/35.5 R |

*Primary Examiner*—Stanley N. Gilreath

*Attorney, Agent, or Firm*—McGlew and Tuttle

[57] ABSTRACT

In order to transfer the starting end (11) of a thread on a bobbin (1) or cop inserted in a bobbin holder (5) of a spooling frame (4), automatically from the bobbin (1) to a suction hole (3) of the spooling frame (4), a pneumatically operated conveyor device is used. The basic component of this device is a suction member (13) with a suction duct (14) formed of a pair of openable plates (26) and (27), and that can be moved as a unit forward and back in the direction of the axis of the bobbin. Its centering funnel (17) is positioned over the free opening (12) of the bobbin in which the starting end (11) of the thread has previously been tucked. By suction or aspirating compressed air, the starting end of the thread is sucked out of the core and into the suction hole (3). To release the thread connection thus created from bobbin opening (12) to suction opening (3), the suction duct (14) is opened by means of its openable plates (26) and (27). This suction device is preferably combined with a release device for the suction hole (3) which at the appropriate time will control a closing member (21) to pivot or slide so that its through hole (22) is aligned with the suction hole (3) for uncovering or opening the latter.

26 Claims, 3 Drawing Figures

DEVICE FOR TRANSFERRING THE END OF THE THREAD OF A BOBBIN OR COP FROM THE BOBBIN CORE TO A SPOOLING FRAME

FIELD AND BACKGROUND OF THE INVENTION

The present invention in general to the field of thread winding equipment, and in particular to a new and useful device for transferring the end of the thread of a bobbin or cop from the bobbin core to a suction hole, that is coverable by a closing member, on a spooling frame, where the starting end of the thread before transfer preferably extends into the free bobbin opening that is directed toward the device.

Spooling frame shave a plurality of bobbin receptacles arranged serially in which bobbins, particularly of the type known as cops, are inserted. The thread or the like—hereinafter the term "thread" will be used, but should not be construed limitatively—is drawn off in the spooling frame from the bobbin and wound into a new bobbin, particularly a cross-wound bobbin. In the process, the thread is check for bad spots and cleaned. Bad spots are cut out. Customarily every bobbin is situated in a holder that rotates around a central axis somewhat like a revolver and holds a plurality, five or six, for example, of bobbins. After unwinding and ejection of the empty bobbin core, this device is moved forward one position at a time. In the free recess or receptacle provided for the purpose, a new bobbin to be unwound is inserted. One end of the thread on this bobbin—referred to herein as the "starting end of the thread"—is tucked into one of the openings of the bobbin prior to insertion. During processing the bobbins assume an upright but slightly inclined position, so that they stand on one end, while the other free end points upward, generaly at a slant. The opening of this free end of the bobbin, as noted, holds the starting end of the thread.

The "rewinding" of said inserted bobbin onto a bobbin to be newly wound is accomplished completely automatically. In general, however, it is necessary for the staring end of the thread to be first brought over into a suction hole of the spooling frame. With the aid of the closing member and/or the suction draught it is held there. The segment of thread between the suction hole and the bobbin is automatically taken up by the spooling machine and wound around the new core.

SUMMARY OF THE INVENTION

The object of the invention, therefore, is to create a device of the kind described above with which the starting end of the thread can be transferred automatically from the bobbin to the suction hole of the spooling machine.

Accordingly, another object of the invention is to provide a device for transferring the starting end of a thread on a bobbin with a bobbin core having a free bobbin opening, from the free bobbin opening to a suction hole of a spooling frame carrying the bobbin, comprising a suction member having a suction duct, said suction duct being divided along its length and functioning for pneumatically connecting the free bobbin opening with the suction hole, suction member drive means connected to said suction member for moving one end of said suction duct into the proximity of the free bobbin opening and teh opposite end of said duct into the proximity of the suction hole, a closing member or element movably mounted over the suction hole for opening and closing the suction hole, actuating means connected to said closing member for moving said closing member to opening and close the suction hole, and duct opening means connected to said suction member for opening said suction duct along its divided length to permit exit of the starting end of the thread.

The suction member of this device is positioned over the free end of the bobbin, but need not necessarily enclose the corresponding end of the bobbin or core securely or tightly. It should, however, be close enough to the free end of the core that there is no difficulty in aspirating the starting end of the thread which has been tucked into the hole or free opening of the core. The starting end of the thread is then sucked in by the suction duct, one end of which is associated with the free bobbin opening and the other with the suction hole of the spooling frame. The suction draught is strong enough and the suction time long enough to unwind enough thread from the spool so that a sufficient amount of the thread can be sucked into the suction hole of the frame. Then the device must be raised by suitable means. So that the thread is not pulled out of the suction hole in the process, a crosswise outlet of the device is first opened up, through which the transferred starting end of the thread can exit. To be more precise, the starting end of the thread remains where it is, at least at first, and the device is simply moved away from the starting end of the thread. The crosswise outlet is created by dividing the suction duct in two down or along its length and moving one half of the duct away from the other. In principle it is unimportant whether one moves only one half of the duct or both at the same time. The width of the crosswise outlet should be of such a dimension that the starting end of the thread can confortably pass through it, and in particular can fall out of it by its own weight.

In a further improvement on the invention it is proposed that the suction member consist of two hinged suction member sections. In this case, the crosswise outlet is between the axis of the hinge and the free opening of the bobbin. The two sections of the suction member can pivot relative to one another, and the term "hinged" expresses the fact that the crosswise outlet is located somewhat below the axis of pivoting or the hinge axis, which axis need not necessarily be horizontal. In the embodiment shown, for instance, the hinge axis is not horizontal, but on a slant.

Another development of the invention is to have the hinge axis located at the rear end of the suction member from the standpoint of its advancing direction and to have the body of the suction member consist essentially of two plates. When they are swung apart, the crosswise outlet is open; in other words, it is created by the gap that appears between the two plates.

A preferred embodiment of the invention is characterized by having a centering funnel on the end of the suction duct towards the free and of the bobbin. It can be designed so that both further thread windings or coils and even a thread end lying outside on the cop in the area of the centering funnel can be sucked up. The axis of the centering funnel runs, at least when in its operating position, roughly in the same direction as the axis of the bobbin or cop. The bobbins are not in a precisely defined position in the spooling frame; rather, the free end of the bobbin can be positioned within a given range. The centering funnel should thus be dimensioned so that it can be placed normally over the free bobbin or core end. Said core end then slides along the inner wall of the funnel, so that once the movement of placing the funnel is completed the free end of the bobbin is aligned with the funnel pipe or the like.

Another variation on the invention is to have a funnel-like expansion at the end of the suction duct towards the suction hole. Here again, the axis of the funnel in its operating position lines up at least approximately with the axis of the associated end of the suction duct. It is particularly advantageous to have a sealing collar located just before the funnel-shaped expansion of the end of the suction duct on the suction hole side. It is preferably made of a flexible material such as rubber or plastic. Due to the funnel-shape, this end of the duct, too, can be reliably applied to the suction hole of the spooling frame. It is advisable to put the closing member into its release position before applying the sealing collar.

A further improvement on the invention is characterized by having the suction duct in the shape of an arc and having a lateral half of the duct in each plate of the body of the suction member. In this way one can design and preferably even dimension the two plates the same.

A further development on the invention provides that in a device for a spooling frame where the closing member or element for the suction opening is designed as a rotating or sliding plate with an air through hole, in the release position of the suction hole the air through hole is covered by the sealing collar. Leaks are thus avoided at the critical spot, so that the effectiveness of the suction device is insured.

Another variation on the invention consists in making the closing member movable by a first controllable electromagnet. Since the closing member executes a sliding or rotating motion, the magnet should preferably be a solenoid. The return of the closing member can be effected by the force of a spring.

A further preferred embodiment of the invention is characterized in that the electromagnet is connected to a pivoting lever that engages specifically via its free end with the closing member, preferably with an edge of the closing member. In the latter case the closing member is dish-shaped. One form in particular is to place a roller on the free end of the closing member to cut down on friction. In addition, it is proposed that the pivoting lever be returned to starting position by a return spring, which may, for example, consist of a coil spring on the axis of rotation. The axis of rotation of the lever runs in particular perpendicular to the direction of the axis of rotation of the plates and also perpendicular to the plane of the plates. Another variation on the invention consists of allowing both plates of the body of the suction member to swing open and back together by means of a second controllable electromagnet. If said magnet only accomplishes the opening, the closing is effected either by the force of gravity of by the force of a spring. In a particularly advantageous version the second electromagnet is a rotary magnet, and the two plates of the body of the suction member can be swung open and shut by means of at least one link control. With the latter, one can dispense with a spring for closing. with a link or cam control, the rotary motion of the magnet is transformed into a pivoting or swinging motion by the use of an inclined plane.

A further development of the invention is characterized in that the axis of rotation of the rotary magnet supports a level, particularly a two-armed lever having two pins. The pins engage arc-shaped slots of control lugs which are each on a corresponding plate of the body of the suction member. The axis of rotation of the rotary magnet is parallel to the pivoting axis of the plates. The arc shaped slots naturally do not run concentric to the magnet's axis of rotation, but rather in a narrowing direction in order to create the abovementioned "inclined plane." In the embodiment given as an example, the relationships are so set up that in the starting position, i.e. when the suction member is closed, the two pins and the axis of rotation of the solenoid are on a plane that runs preferably perpendicular to the open direction.

The suction member and the device for actuating the closing member of the suction hole are, in a further development of the invention, mounted on a support which is capable of moving back and forth in approximately the longitudinal direction of the bobbin. This support is at first so oriented with respect to the bobbin that the centering funnel can be set upon the free bobbin end by a simple, straight-line movement.

Another development of the invention consists in having a preferably plate-shaped bearing member guide mounted on the support around an axle that is perpendicular to the forward direction of the support and parallel to the pivoting axis of the plates of the suction member and is centerd by a spring in a base position. If, because the bobbin is in an extreme position in its spooling frame holder, the free end of the bobbin or core cannot get inside the funnel, but comes to rest on the rim of the centering funnel, the pivoting bearing of the suction member via the plate-shaped bearing member causes the latter to swing. The swinging comes about simply because of the off-center application of force with respect to the pivoting axis of the bearing member. This prevents damage to the bobbin or jamming of the device.

This safety precaution also works when the bobbin is inside the centering funnel and the device jams in its suction position while the bobbin feed device moves, and also and especially when, with the device in suction position, the bobbin holder on the spooling frame continues to rotate by at least one unit.

In this connection, an advantageous version of the invention provides for a stationary switch connected with the support and a switching member connected with the bearing member, which together constitute a shut-off device for a bobbin feed device. The deflection of the plate-shaped bearing member can be combined with an acoustical and/or optical warning device. After correct orientation of the bobbin and return of the deflected bearing member with the devices situated theron, the automatic thread transfer can be resumed.

Another preferred embodiment of the invention is characterized in that the support is slidably and lockably mounted on a guide mechanism or base mechanism of the device that runs roughly parallel to the longitudinal axis of the bobbin. This guide mechanism insures precision in the advance of the support and hence also the suction member, as well as the actuating device for the closing member. However it offers yet another advantage, which is that the support can be moved up and down, particularly inclined to the vertical, by means of an electric motor. the motor can move the support and the parts connected with it forward and back both quickly and in a manner adjusted to the situation. One particular consideration here is that one can use an appropriate drive motor or drive control which will offer at least the choice of a rapid and a crawl motion.

Another particular variation of the invention in this regard is characterized by a number of switches on or along the guide mechanism for controlling at least the electric motor and the electromagnets by acting together with a switching element on the support. The latter need not necessarily be directly connected with the support. Thus, when the support moves past the switches, which are specifically arranged so that at least some of them come one behind the other in the direction of travel of the support, this leads, at least during the advance motion of the suction member, to simultaneous and/or serial switching procedures, with the switching to be described in greater detail.

The driving motor, in a particularly advantageous version, is a permanently excited motor, particularly one with a four quandrant drive control. In a further development of the invention, it is provided that the motor drives, particularly indirectly, a threaded spindle that runs parallel to the guide mechanism of the support and engages with a pivoting but nonsliding nut or the like mounted on the support. A turn of the spindle thus results in a shifting of the nut and all parts unshiftably coupled with it. By varying the rotary motion one can alter the shifting motion.

Another development of the invention consists of providing a monitoring device for the thread in the suction duct of the suction member. With its aid one can determine whether, on completion of the procedure, the starting end of the thread has actually been sucked up and carried to the suction hole of the spooling frame. A convenient device for this purpose is an optical monitoring device with a light source and a detector. It can be hooked up both with a warning signal and also with the controls, so that the thread transfer process can be repeated a number of times.

Another variation on the invention is characterized in that a compressed air duct empties out into the suction duct, its outlet being directed toward the suction hole of the spooling machine. It thus produces by aspiration a suction effect on the bobbin and replaces or possibly reinforces a suction draught in the suction line of the spooling machine that has the suction hole. Another improvement on the invention is characterized by at least one rolling or sliding element for slidable mounting of the device on a lengthwise guide rail of the spooling frame. This makes it possible to move the device from one work station on the spooling machine to the next. This happens more particularly with the aid of a driving motor and a control mechanism which insures that the device does not move forward to the next work station on the spooling frame until the starting end of the thread has actually been transferred at the station at which it is currently stopped.

A further object of the present invention is to provide a device for transferring the starting end of a thread which is simple in design, rugged in construction and economical to manufacture.

The various features of novelty which characterize the invention are pointed out with particularlity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

BRIEF DESCRIPTION OF THE DRAWINGS

The invention is explained below on the basis of the drawings, wherein.

DESCRIPTION OF THE PREFERRED EMBODIMENT

Figure 1:
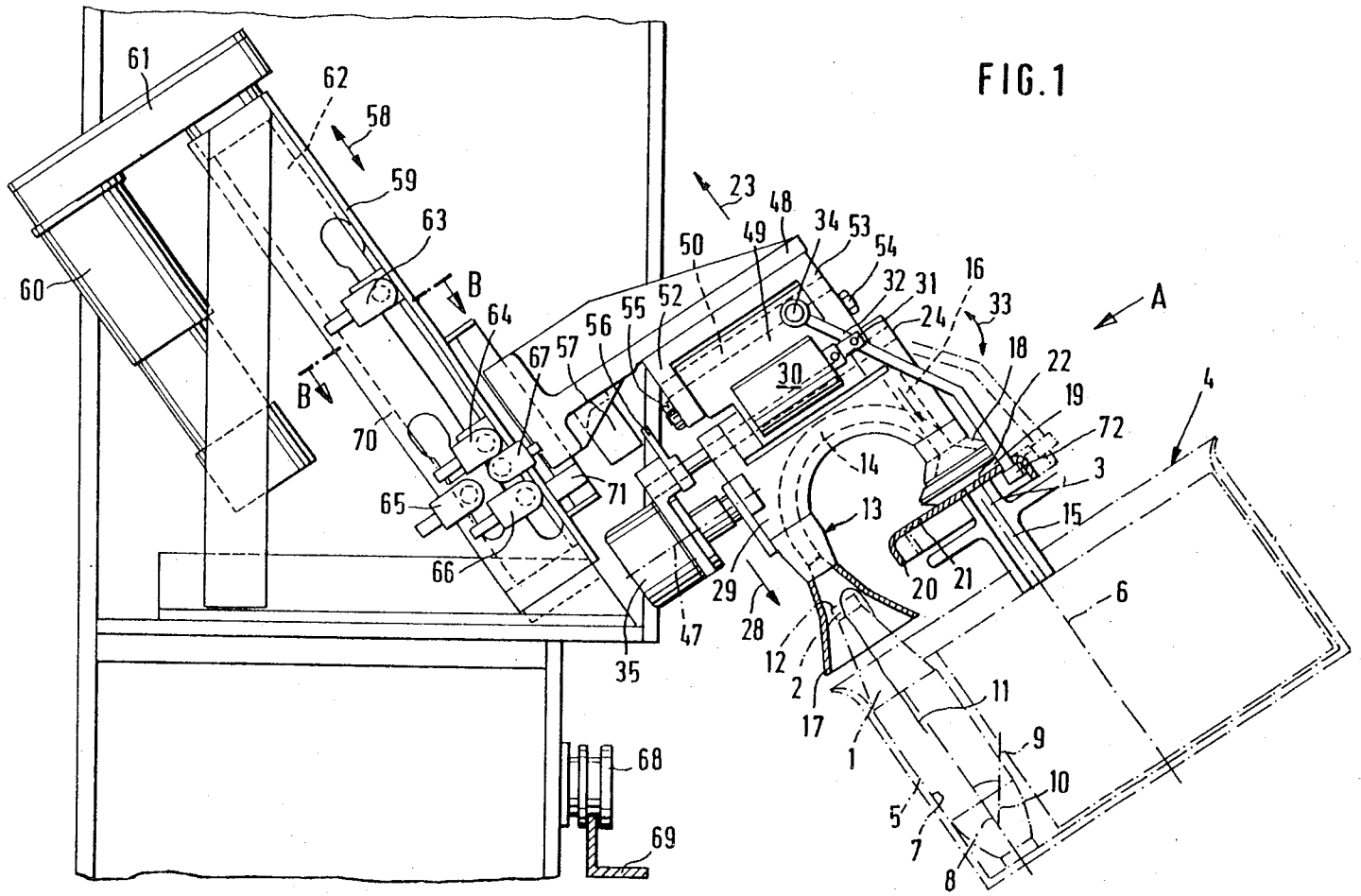
FIG. 1 is a side view of the inventive device, partially cut away.

FIG. 1 shows the device in its operating position, i.e. most of its components are in an inclined position. The device is used to transfer the starting end 11 of the thread of a bobbin 1, of the kind known as a cop, from the bobbin core 2 to a suction hole 3 of a spooling frame 4. Of the frame 4, however, only the portion of a bobbin holder 5 is to be seen, that is rotationally symmetrical and rotates about an axis 6 of the frame. Frame 4 possesses a number of receptacles 7, holding one bobbin 1 each, that are disdistributed around the circumference of the frame and moved ahead step by step, so that at any given moment one bobbin 1 is in the position shown in the drawing with respect to the transfer device. Hence, in the thread transfer position, the bobbin 1 or its longitudinal axis 8 is inclined at an angle 10 to the vertical 9.

Before the bobbin 1 is inserted in the bobbin holder 5, the starting end 11 of the thread is stuck into one of the bobbin openings, which after insertion in the bobbin holder 5 projects above the latter and thus constitutes the free bobbin opening 12. Each spooling frame possesses a plurality of such bobbin holders, particularly at equal intervals side by side on frame 4. The thread is unwound from the bobbin core 2 in the spooling machine, checked and "refined" by the removal of bad spots, and then rewound into a new bobbin, preferably a cross-wound bobbin. For this purpose it is necessary for the starting end 11 of the thread to be brought to the suction hole 3 and held there until the segment of thread between bobbin 1 and suction hole 3 is grasped by an appropriate organ and fed to the spooling frame for further processing.

Pursuant to the invention, the starting end 11 of the thread is transferred automatically with this novel device from the bobbin 1 to the suction hole 3. For this purpose, a suction member 13 with a suction duct 14 is set on top of the free bobbin opening 12, the suction duct being arc-shaped in the embodiment used as an example. A pneumatic link is thus created between the bobbin 1, or the free bobbin opening 12, and the suction hole 3 of the spooling frame. With the help of the suction prevailing in the suction duct 14 the starting end 11 of the thread is sucked out of the inside of the core 2 and transported, while a segment of thread is unwound from the bobbin 1, through the suction duct 14 into the air duct 15 of the spooling machine, the free end of which duct constitues the abovementioned suction hole 3. In this case one utilizes the partial vacuum device usually to be found on a spooling frame. Instead of that, however, it is readily possible to have a compressed air duct 16 feed into the suction duct 14 as shown by way of example with dot-dash lines in FIG. 1. The compressed air thus fed in also results, by aspiration, in a suction effect in duct 14, so that with the aid of compressed air one can suction up the starting end of the thread and transport it to duct 15. Moreover, one can set up a monitoring device at an appropriate spot with which to check or ascertain that the transfer of the starting end of the thread from the bobbin 1 to the spooling frame 4 has taken place. A convenient device for the purpose is an optical monitoring device in the area of the suction duct 14.

The bobbin 1 will not necessarily be in the position shown in FIG. 1 in the bobbin holder 5; instead, it may be somewhat askew; in other words, the free end of the bobbin may swivel into or out of or across the projection plane. In order to set the suction member 13 reliably on the free end of the core notwithstanding its position in holder 5, a centering funnel 17 is provided on the end of the suction duct 14 that is toward the free bobbin opening 12. On the other of the suction duct 14 (the one towards the suction hole 3) another funnel-like expansion 18 is provided. to this is fastened a sealing collar 19 of a soft, elastic material such as rubber, plastic of the like. During the thread transfer operation, however, collar 19 does not lie directly on the upper end on the air duct 15, but on an intervening closing member or element 21 for the suction hole 3, which closing member 21 is constructed in the shape of a dish with its edge 20 bent down. This closing member is eccentrically rotatably or slidably mounted on the top of the bobbin holder 5. It has a through hole or aperture 22 that, in the starting position, in other words, before the centering funnel 17 is set on the free end of the bobbin, is situated to the side of the suction hole, so that the suction hole is covered by the closing member 21. Not until the closing member is slid or turned in the manner to be described below, is the pneumatic connection between the air duct 15 and the suction duct 14 established via the through hole 22. The sealing collar 19 is not pressed on until after the opening of the suction hole 3.

Figure 2:
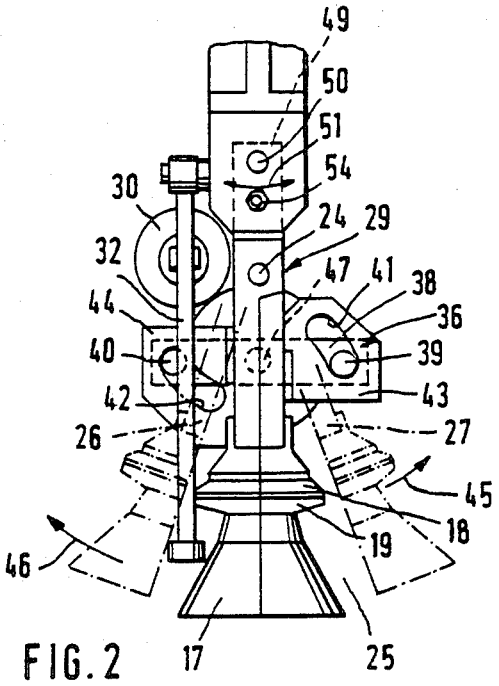
FIG. 2 is a partial view of FIG. 1 taken in the direction of arrow A and with the suction hole structure and spool frame removed.

When the starting end of the thread is transferred into the suction hole 3, the suction member 13 must be taken off. This occurs by lifting in the direction indicated by arrow 23. In order to prevent the starting end of the thread from being carried along in this lifting movement, a cross-wise outlet for the thread is first opened up. The crosswise thread outlet is made possible by the fact that the suction member consists of two sections 26 and 27 (FIG. 2) hinged together around an axis 24. These sections can be folded in on one another or opened up, as needed. While the suction is operating the two sections, in particular the two halves, are naturally folded together—as shown in FIG. 2 with solid lines—whereas they are swung out away from one another as shown by broken lines in FIG. 2 in particular while the device is raised in order to create the crosswise outlet 25.

The two hinged sections 26 and 27 of the suction member are essentially plate-shaped elements. They are constructed so that one half of the suction duct 14 is defined and situated in each of them. As a result, each suction member section also bears, i.e. laterally, half a centering funnel 17 and half of funnel 18 with half a collar 19.

From the drawing one can also see that the hinge axis 24 is situated at the rear end of the suction member 13 with respect to the direction 28 in which it is lowered into place. The two hinged plates constitute the body 29 of the suction member.

The closing member 21 is movable by means of a first controllable electromagnet 30. Its armature is coupled via a bolt 31 to a lever 32 that pivots in the direction indicated by the double arrow 33. The axis of rotation 34 of the lever lies, pursuant to FIG. 1, over the solenoid 30, and the lever is one-armed. At its free end it bears a roller 72. In FIG. 1, the operating position of the lever 32 is shown with solid lines. Its starting position is shown in broken lines. In this starting position the closing member 21 still holds the suction hole 3 closed. If current is applied to the solenoid 30, the armature moves the lever 32 from the position shown with broken lines to that shown with solid lines, whereby upon contact of the pivoting lever roller 72 against the exterior of the closing member bent down dish edge 20, the closing member 21 is pivoted or shoved into its shifted position, in other words, the position in which the suction hole 3 is released or opened, as shown in solid lines. The deflected parts, i.e. the lever 32 and the closing member or element 21, can be returned to starting position by the force of return springs after the solenoid 30 is deenergized. A return spring for the lever 32 is located by or in the solenoid 30.

The spreading of the two plates or sections 26 and 27 of the body 29 of the suction member is also accomplished with the aid of a magnet, specifically a second controllable electromagnet 35. It should preferably be a rotary magnetic that opens and shuts the two plates or sections 26 and 27 of the suction member via a preferably doubled link control 36 shown in FIG. 2.

For this purpose, the axis of rotation 47 of the second magnet 35 bears a double-armed 38, on each end of which is situated one of the pins 39 or 40 of the link control. Each engages in an arc-shaped slot 41 or 42 of the control lug 43 or 44 of the corresponding plate or the corresponding section 26, 27 of the suction member. If the armature of the magnet turns, it results in a pivoting movement of the double-armed lever 38 with the pins 39 and 40. Because of the path of the arc-shaped slots, which is inclined relative to and non-concentric to the axis of rotation 47 (see FIG. 2)

the pins 39 and 40 press the control lugs 43 and 44 and hence the suction member sections 26 and 27 outwardly in the direction of the arrows 45 and 46. The wedge-shaped gap that appears between the two suction member sections 26 and 27 creates the abovementioned crosswise outlet 25 for the transferred thread end. When the suction duct 14 is closed, the axis of rotation of the second magnet 35 and the pins 39 and 40 lie on the same straight line or plane. Furthermore, it is apparent from FIG. 2 that the axis of rotation of the second magnet 35 is positioned parallel to the hinge axis 24 of the plates or suction member sections 26, 27.

The suction member 13 and the mechanism for actuating the closing member 21 of the suction hole 3, basically therefore the lever 32 and the first magnet 30, are carried on a support 48 capable of movement forward and back in roughly the longitudinal direction of the bobbin 1. Between the support and the suction member 13, however, another plate-shaped bearing member or guide 49 intervenes. It is pivotally mounted on the support 48 around an axis 50 so that it can swing in the direction indicated by the double arrow 51. For this purpose the support 48 has two mounting brackets 52 and 53 that receive the bearing member 49 between them. The abovementioned hinge axis 24 for the suction member 13 runs parallel to the axis 50 of the bearing member, as can be seen particularly in FIG. 1. Both figures show that the bearing member 49 is held in its normal position with the aid of two centering devices 54 and 55 intervening between the mounting brackets and the corresponding ends of the bearing member, which devices may be constructed as a kind of snap-lock and permit the bearing member 49 to swing with respect to the support 48 when a swinging impulse greater than the holding force of the snap lock acts on the bearing member 49. This may be the case if the position of the bobbin 1 deviates radically from that shown, so that the free end of the centering funnel 17 hits the free end of the core, or if the bobbin is inside the centering funnel and the device jams in its lowered position while the bobbin feed device moves forward or if the bobbin holder moves forward in the spooling frame while the device is in its lowered position. This creates a torque which is communicated to the bearing member 49 via the hinge axis to which it is connected 24 and thus causes the bearing member to swing. A switching member or actuator 56 connected to the bearing member 49 operatively via the hinge axis 24 shares this deflection movement and thereby actuates a tilt switch 57 stationarily mounted on the support 48, i.e. since bearing member or guide 49, hinge axis 24, body 29, first solenoid magnet 30, lever 32, second rotary magnet 35, and switching member or actuator 56, all rotate about the axis 50 under such deflection movement.

One can make appropriate use of this switching process, for example, to switch off a device for automatic feed of bobbins 1 into the bobbin holder 5.

Switch 57 may be a proximity switch with switching member 56 merely being a metal bar needed to trip the proximity switch. The centering devices 54 and 55 may also be of known design, for example, dish springs which are urged against the sides of bearing member 49 by bolts, the springs having notches which sit in notches of the bearing member to establish the center position but which may move out of the center position with tilting of bearing member 49.

The support 48 is mounted on a guide mechanism or base mechanism 59 of the device in such a way that it can be slid in the direction of the double arrow 58 and locked into position. This guide mechanism runs roughly parallel to the longitudinal axis 8 of the bobbin and the axis of rotation 6 of the bobbin holder 5. This enables the centering funnel 17 to be lowered centrally over the end of the bobbin core 2, which projects upward at the inclined angle 10. The support 48 thus slides up and down at an angle to the vertical, and does so with the aid of an electric motor 60. The latter is a permanently excited motor (i.e. permanent magnet equipped, rather than electromagnet equipped, motor) with a four-quandrant drive control (i.e. fast and slow forward speed, and slow and fast reverse speed, drive for lowering and raising support 48 to shut down position, respectively in conjunction with sequence switches as noted below). Its rotary motion is communicated via a drive mechanism 61, e.g. a toothed belt drive, to a spindle 62 which engages with a nut turnably but unslidably mounted on the support 48. A turn in one direction brings about a raising of the support 48 and all parts unshiftably mounted thereon in the direction of the arrow 23, while a counterturn results in lowering it in the direction of the arrow 28.

Figure 3:
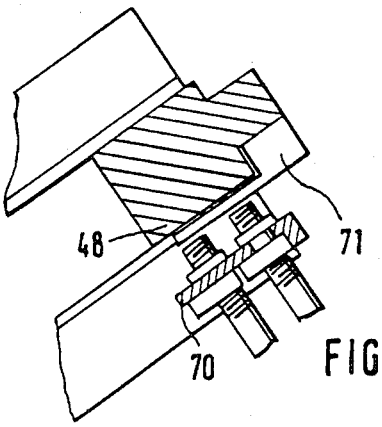
FIG. 3. is a partial sectional view of FIG. 1 taken along the line B—B.

FIG. 1 shows that along the guide mechanism 59 are mounted various sequence switches, in particular non-contact (proximity) electrical or electronic switches. They are labelled by reference numbers 63, 64, 65, 66 and 67 and are continuously adjustable on a guide strip 70. They work in conjunction with a switching element 71 that moves along with the support 48 (see FIG. 3).

Starting with the support 48, and hence the suction member 13 as well, in its end raised position, the advance or lowering of the suction member 13 is set in motion by a corresponding order from the electrical drive motor 60, i.e. via a suitable control means switch in conventional automatic timed cycle manner.

At this point the suction member 13 is still closed, i.e. the rotary second magnet 35 for opening the suction duct 14 is not being fed with current and the two sections 26 and 27 are folded together.

After the unit passes in downward direction such that the switching element 71 on the support 48 operates the switch 63, the rotary magnet 35 is switched on and the suction member 13 is thereby opened, and its sections 26 and 27 swung open.

When the switching member 71, which has travelled along with the support 48, reaches switch 64, the current flowing through the second magnet 35 is again interrupted, resulting in the coming together of the two halves of the suction member into operating position, making possible the centering of the cop. Switch 67 is responsible for effecting a switch from the rapid motion heretofore prevailing to a crawl motion of motor 60, in other words, a slower rate of advance. The actuation of switch 65 controls the supply of current to the solenoid 30 and thus when actuated, once the downwardly moving roller 72 reaches and rests against the exterior of the edge 20, under the action of the return springs thereof, causes the lever 32, i.e. against the action of its return spring, to swing in and, in turn, the urging of roller 72 against the edge 20 to move the closing member 21, for the release or opening of the suction hole 3 by the closing member 21 movement, i.e. against the action of the closing member return spring.

Switch 66, finally, puts a stop to forward motion in the direction of the arrow 28 by shutting off motor 60, i.e. when the downwardly moving collar 19 reaches and contacts the now shifted control member 21. When the corresponding command to the motor 60 by the control means switch is given, to the motor 60 the reverse order of the operation of the switches and the parts controlled thereby is effected, such that the support 48 is raised back up starting in slow motion via switch 66 and then continuing in rapid motion via switch 67, and via switches 64 and 65 the suction member 13 is swung open and the closing member 21 is moved into its closed position via its return spring, as the case may be.

When switch 63 is reached, finally, the suction member 13 is swung shut again as the rotary second magnet 35 is deenergized, the motor 60 is shut off and the support 48 is hence stopped. The device of the base mechanism 59 is equipped with rollers 68, sliding blocks or the like on which it can be moved along a guide mechanism, in particular a guide rail 69 on the spooling frame that is perpendicular to the projection plane in FIG. 1.

While specific embodiments of the invention have been shown and described in detail to illustrate the application of the principles of the invention, it will be understood that the invention may be embodied otherwise without departing from such principles.

What is claimed is:

1. Device for transferring the starting end of a thread on a bobbin, having a bobbin core with a free bobbin opening, from the free bobbin opening to a suction hole of a spooling frame carrying the bobbin, comprising a movable suction member having a lengthwise suction duct provided with a bobbin end and a suction hole end, for pneumatically connecting the free bobbin opening with the suction hole for drawing the thread starting end from the opening through the duct to the hole, the duct being divided along its length for permitting opening thereof to release the thread starting end once it has been drawn to the hole, drive means for moving the member toward the spooling frame to bring the bobbin end adjacent the opening and the hole end adjacent the hole, and duct opening means operatively connected to the member for opening the duct along its lengthwise divide to release the thread starting end therefrom.

2. Device of claim 1 wherein a closing element is movably mounted relative to the member and hole for opening and closing the hole, and actuating means arranged for moving the element to open and close the hole.

3. Device of claim 2 wherein the element has an air through aperture therein, the actuating means moving the element to align the aperture with the hole when the member is moved adjacent the hole, thereby to open the hole, and moving the element to misalign the aperture with the hole when the member is moved away from the hole, thereby to close the hole, and a sealing collar connected to the member for engaging around the hole end and engageable against the element for sealing the hole end with the aperture and hole when the member is moved adjacent the hole and the hole is open.

4. Device of claim 3 wherein the actuating means includes a first electromagnet operatively arranged for moving the element to align the aperture with the hole to open the hole.

5. Device of claim 4 wherein the element has an outer edge, and the actuating means includes a first lever pivotally mounted relative to the member and operativly connected to the first electromagnet for being pivoted thereby to cause the first lever to engage operatively the outer edge for moving the element to align the aperture with the hole to open the hole.

6. Device of claim 4 wherein the duct opening means includes a second electromagnet operatively arranged for opening and closing the duct along its lengthwise divide.

7. Device of claim 1 wherein a centering funnel is connected to the member and surrounds the bobbin end for engaging the bobbin around the opening when the member is moved to bring the bobbin end adjacent the opening.

8. Device of claim 7 wherein a funnel shaped expansion is connected to the member and surrounds the hole end for engaging the hole when the member is moved to bring the hole end adjacent the hole.

9. Device of claim 8 wherein a sealing collar is provided on an outer end of the funnel shaped expansion, a closing element is movably mounted relative to the member and hole for opening and closing the hole, and actuating means arranged for moving the element to open and close the hole, the collar being engageable with the element when the member is moved to bring the hole end adjacent the hole and the actuating means have moved the element to open the hole.

10. Device of claim 1 wherein the member includes two sections hinged together at a hinge axis, at least part of the duct being defined in each of the sections.

11. Device of claim 10 wherein the two sections include two plates hinged together at the hinge axis for swinging outwardly and inwardly about the hinge axis, and the hinge axis is disposed at a rear location on the member relative to the direction of movement of the member toward the opening and hole.

12. Device of claim 11 wherein the duct has an arc shape, one lateral half of the duct being defined in one of the plates and the other lateral half of the duct being defined in the other of the plates.

13. Device of claim 11 wherein the duct opening means includes an electromagnet operatively arranged for swinging the plates about the hinge axis for opening and closing the duct.

14. Device of claim 13 wherein the electromagnet comprises a rotary electromagnet, a link control operatively interconnecting the rotary electromagnet and the plates for swinging the plates for opening and closing the duct.

15. Device of claim 14 wherein the rotary electromagnet has a rotational axis substantially parallel to the hinge axis, and the link control includes a double armed lever mounted to the rotary electromagnet for rotation about the rotational axis, a pair of pins connected to opposite ends of the double armed lever, and a control lug connected to each of the two plates, each lug having an arc shaped slot therein extending in an outwardly and inwardly inclined direction to and non-concentric to the rotational axis, one of the pins engaged in each slot whereby rotation of the double armed lever by actuation of the rotary electromagnet causes the pins to urge the lug slots correspondingly outwardly and inwardly relative to the rotational axis for swinging the two plates outwardly and inwardly about the hinge axis.

16. Device of claim 11 wherein the drive means includes a traveling support mounted for movement parallel to the axis of a bobbin in the spooling frame toward and away from which the member is mounted for movement.

17. Device of claim 16 wherein a plate shaped bearing guide is mounted to the support for pivoting about a bearing axis and carrying the hinge axis and the two plates, the bearing axis being substantially parallel to the hinge axis and the direction of movement of the support being substantially perpendicular to the bearing axis.

18. Device of claim 17 wherein centering means are connected between the guide and the support for maintaining a centered position of the guide relative to the support.

19. Device of claim 17 wherein a tilt switch for controlling a bobbin feed device is connected to one of the support and guide and a counterpart switch actuator is connected to the other of the support and guide, the actuator actuating the tilt switch when the guide is tilted out of a centered position relative to the support.

20. Device of claim 19 wherein the drive means includes a guide base mechanism on which the support is mounted for sliding movement.

21. Device of claim 20 wherein the base mechanism mounts the support for movement at an inclined angle to the vertical, and an electric motor is supported on the mechanism and operatively connected to the support for moving the support.

22. Device of claim 21 wherein a plurality of sequence control switches is provided which are connected to the base mechanism and disposed in a path of movement of the support, at least one of the sequence switches being connected to the motor for starting and stopping the motor to start and stop movement of the support.

23. Device of claim 22 wherein the motor comprises a permanent magnet motor having a four speed drive control for fast and slow forward speed operation and correpsonding slow and fast reverse speed operation, and the sequence control switches are operatively connected to the motor for moving the support along its movement path at an initially fast and terminally slow speed of movement of the member toward the spooling frame, and correspondingly at an initially slow and terminally fast speed of movement of the member away from the spooling frame, and for operating the duct opening means.

24. Device of claim 22 wherein the drive means includes a threaded spindle mounted for rotation to the base mechanism and engaged with the support for moving the support with rotation of the spindle, the motor being connected for rotating the spindle.

25. Device of claim 22 wherein a compressed air duct passage is connected to the member for blowing air outwardly of the hole end to cause a suction effect in the hole of the spooling frame when the member is adjacent the hole.

26. Device of claim 22 wherein movement rollers are connected to the base mechanism, and rails are arranged for mounting the movement rollers for rolling thereon for moving the base mechanism relative to the spooling frame.

* * * * *